United States Patent [19]

Fukuma et al.

[11] Patent Number: 4,599,613

[45] Date of Patent: Jul. 8, 1986

[54] DISPLAY DRIVE WITHOUT INITIAL DISTURBED STATE OF DISPLAY

[75] Inventors: Yoshitaka Fukuma, Yamatokoriyama; Tosaku Nakanishi, Nishinomiya, both of Japan

[73] Assignee: Sharp Kabushiki Kaisha, Osaka, Japan

[21] Appl. No.: 417,883

[22] Filed: Sep. 14, 1982

[30] Foreign Application Priority Data

Sep. 19, 1981 [JP] Japan ..... 56-148101

[51] Int. Cl.[4] ..... G09G 3/00

[52] U.S. Cl. ..... 340/784; 340/814

[58] Field of Search ..... 340/814, 784, 814, 765, 340/802, 711

[56] References Cited

U.S. PATENT DOCUMENTS

| | | | |
|---|---|---|---|
| 3,851,185 | 11/1974 | Hatsukano et al. | 340/814 |
| 3,967,571 | 6/1976 | Brantingham | 340/711 |
| 3,973,254 | 8/1976 | Nomiya et al. | 340/802 |
| 4,005,403 | 1/1977 | Washizuka et al. | 340/814 |
| 4,236,153 | 11/1980 | Aling | 340/814 |

*Primary Examiner*—Marshall M. Curtis

*Attorney, Agent, or Firm*—Birch, Stewart, Kolasch & Birch

[57] ABSTRACT

A display drive especially for use with a liquid crystal display panel is disclosed herein, which avoids disturbance of the contents on display and ensures high degrees of commercial value and display quality of the display. The display drive prohibits operation of the display just after initial power application and thereafter allows the display to operate in normal manner. The display is responsive to the signal for use in data processing, no particular terminals are necessary on integrated circuit devices in receiving externally signals.

5 Claims, 56 Drawing Figures

DISPLAY DRIVE WITHOUT INITIAL DISTURBED STATE OF DISPLAY

BACKGROUND OF THE INVENTION

This invention relates to a display drive for flat panel displays of the liquid crystal or other types.

A conventional type of display drives is adapted such that the contents of a random access memory implemented within integrated circuit devices are displayed. The contents of the random access memory, immediately after power is turned on, generally contain random or void data. This causes a disturbed state of a display panel until normal signals are fed to and placed in the random access memory after power is turned on, lowering the commercial value and quality of the display panel as product.

One solution to this problem is to keep external signals from being fed to the random access memory until normal signals are supplied to the random access memory after power is turned on. For integrated circuit devices including such a random access memory, terminals are necessary to receive display shutoff signals. As is obvious in the art, it is desired that the number of terminals be as small as possible.

OBJECT AND SUMMARY OF THE INVENTION

Accordingly, it is an object of the present invention to provide a display drive which eliminates disturbance of the state of a display panel immediately after power on, without requiring increased use of terminals.

In carrying out the above object, the present invention provides a display device comprising a display, a latch having two stable states, means responsive to the initial application of power for placing said latch into one of said two stable states and forcing said display into its disabled state, and means responsive to a successively developed data processing signal, for placing said latch into the other of said two stable states and forcing said display into its enabled state.

The display drive embodying the present invention avoids disturbance of the contents on display and ensures high degrees of commercial value and display quantity of the display because it stops operation of the display just after power turn on and thereafter allows the display to operate in normal manner. Since the display is responsive to the signal for use in data processing, no particular terminals are necessary on integrated circuit devices in receiving externally signals.

BRIEF DESCRIPTION OF THE DRAWINGS

The present invention will be better understood from the detailed description given hereinbelow and the accompanying drawings which are given by way of illustration only, and thus are not limitative of the present invention and wherein:

FIG. 19 is a diagram illustrating counter 12 of the serial-parallel converter 6 of FIG. 2;

FIGS. 20 and 21 are diagrams illustrating logic for producing clocks $\phi$LS0 and $\phi$LS1 used to clock the flip flops of FIGS. 22,23;

FIGS. 22 and 23 are, respectively, diagrams illustrating flip flops 22,23 which develop logic signals LS0, LS1;

FIGS. 24 and 25 are diagrams of logic circuits which develop logic signals RAS and RAF, respectively;

FIG. 26 diagrammatically illustrates a logic circuit for developing the logic signal L as used by the logic circuit of FIG. 27;

FIG. 27 diagrammatically illustrates a logic circuit for developing the logic signal $\phi$CS;

FIG. 28 is a diagram of a logic circuit including flip flop CS for developing logic signal CS;

FIG. 29 is a diagram of a logic circuit for controlling data transfer on the bidirectional data line SD0;

FIG. 30 is a diagram of a logic circuit for developing the logic signal SDD as applied to the logic circuit of FIG. 29;

FIG. 31 is a diagram of a logic circuit for developing the clock signal $\phi$L as applied to the flip flops of FIG. 18;

FIG. 32 is a diagram of details of the register N;

FIG. 33 is a diagram of a logic circuit for developing the clock signal $\phi$A;

FIG. 34 is a diagram of a logic circuit for developing a write clock signal WR;

FIG. 35 is a diagram of the circuitry of the address register A of FIG. 2;

FIG. 36 is a diagram of a logic circuit which develops logic signals AINC1–AINC7 as utilized by the logic circuit of FIG. 35;

DETAILED DESCRIPTION OF THE INVENTION

Figure 1:
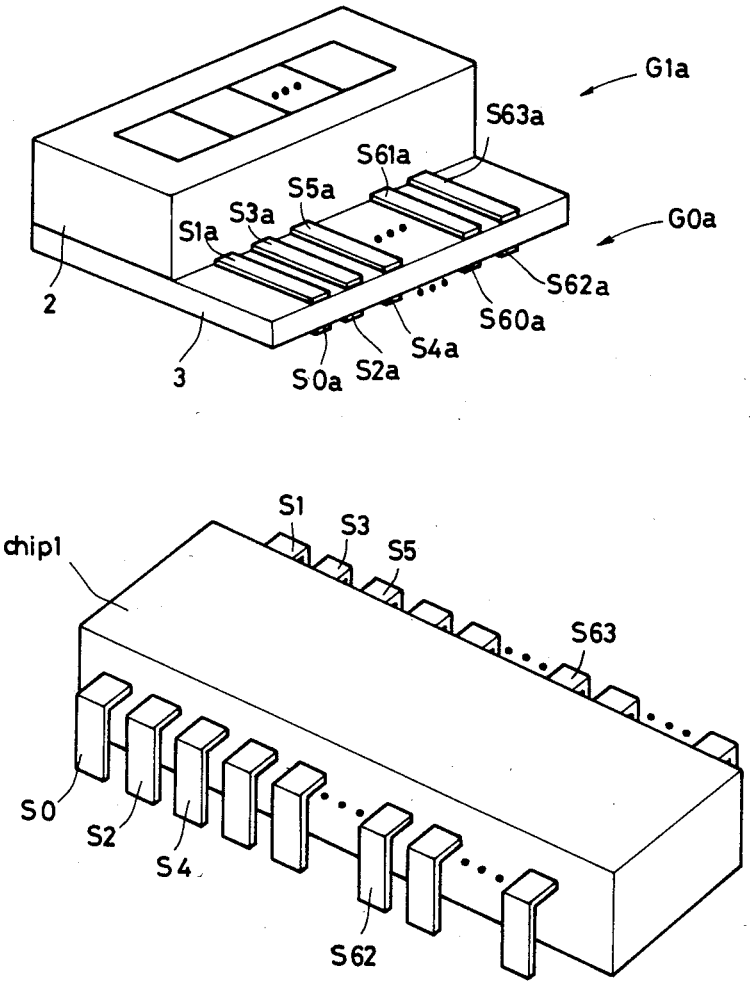
FIG. 1 is a perspective view illustrating a display panel 2 according to an embodiment of the present invention together with a large scale integrated circuit CHIP 1.

In FIG. 1, there is illustrated a perspective view of a display drive according to an embodiment of the present invention. A large scale integrated circuit CHIP 1 includes a circuit for driving a display panel 2 of the liquid crystal type or another well known type as properly retained on a wiring board (not shown). Aligned on both sides of a terminal board 3 of the display panel 2 are input terminals S1*a*, S2*a*, S3*a* . . . S5*a* . . . S63*a* all falling in one group G1*a* of the two groups and input terminals S0*a*, S2*a*, S4*a* . . . S62*a* all falling in the other group G0*a* of the two groups. The display panel 2 has a plurality of segment electrodes which are separated every other electrode so as to classify them into the two groups G1*a* and G0*a* as will be fully discussed below. As shown in FIG. 1, the input terminals S0*a* to S63*a* leading from the segment electrodes in each group are individually disposed together on different sides of the terminal board 3.

Figure 2:
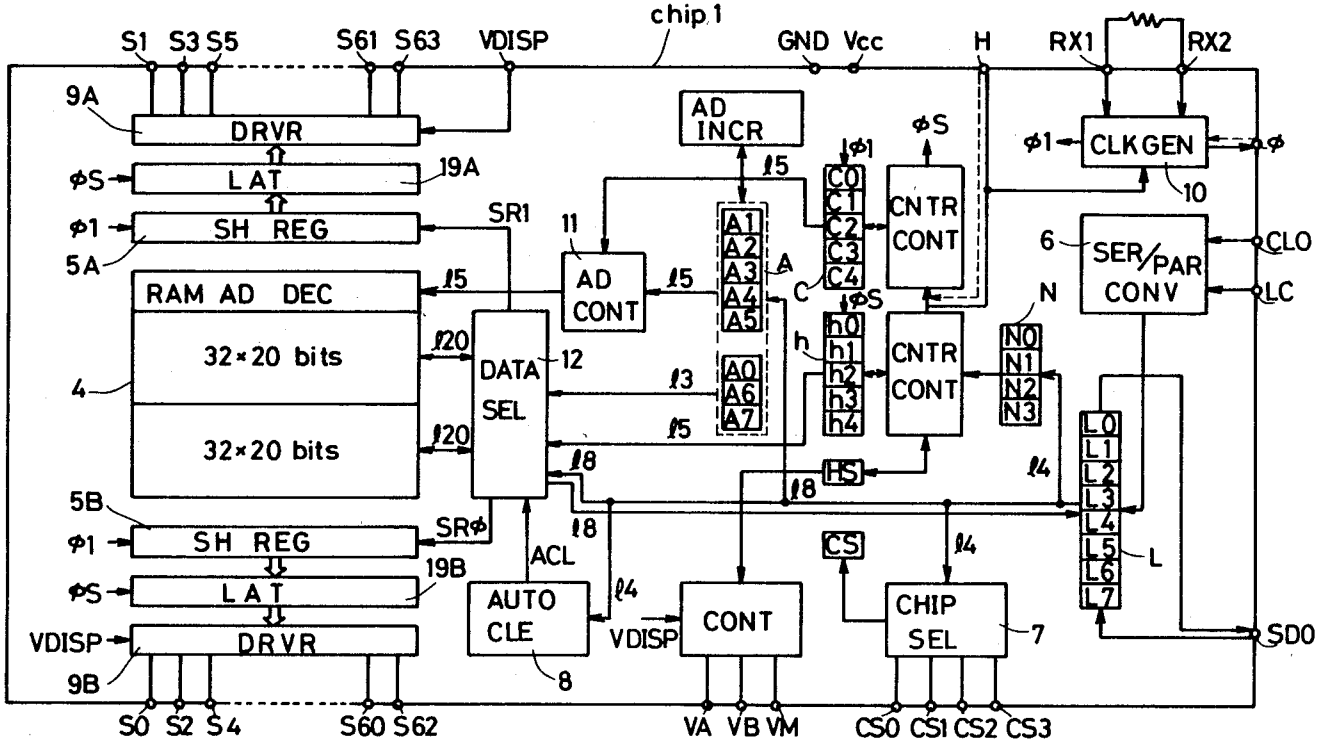
FIG. 2 is a block diagram schematically illustrating the large scale integrated circuit CHIP 1.

The circuit configuration of the large scale integrated circuit CHIP 1 is schematically illustrated in FIG. 2. The large scale integrated circuit generally includes a random access memory 4 for containing display signals; shift registers 5A and 5B for fetching the contents of the random access memory 4 in the form of the display signals; counters c and h for development of the display signals; a serial-parallel converter 6 for data transfer from and to circuits outside of the large scale integrated circuit CHIP 1; a chip select control 7; and auto clear circuit 8 for governing the state of display just after power is turned on; drivers 9A and 9B for driving the display panel 2; and a clock generator 10. As will be described with reference to FIG. 39, there are provided 16 large scale integrated circuit chips CHIP 1 to CHIP 26. In response to signals inputted via terminals CS0W–CS3, the chip select control 7 render desired ones of the large scale integrated circuits CHIP 1 to CHIP 16 active.

(1) Random Access Memory 4

Figure 3:
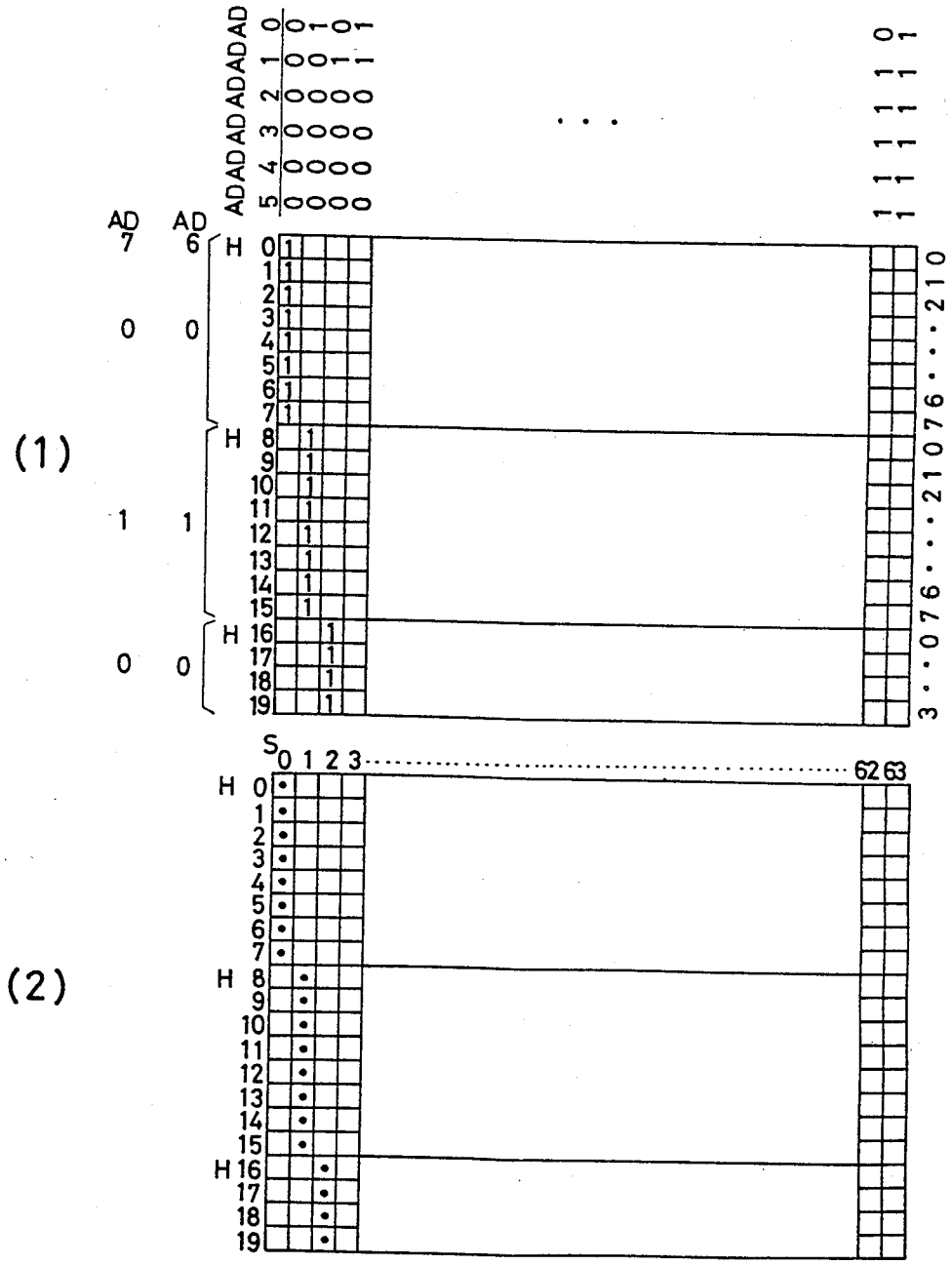
FIG. 3 is a view illustrating store regions of a random access memory.
Figure 4:
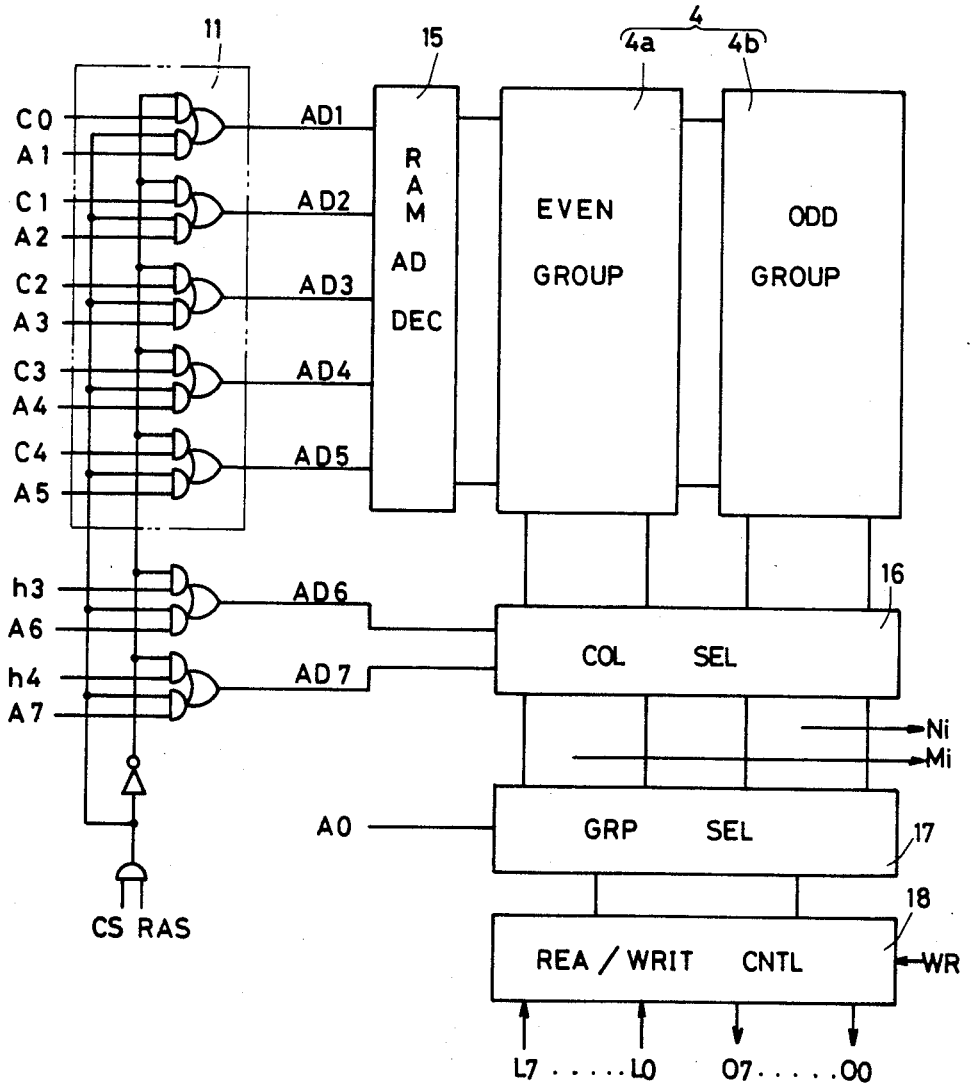
FIG. 4 is a block diagram illustrating the random access memory 4.
Figure 5:
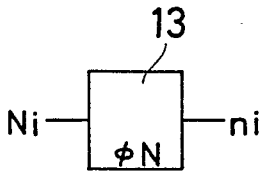
FIGS. 5 and 6 are diagrams of flip flops 13 and 14, respectively.
Figure 6:
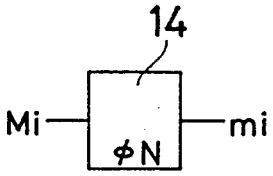

In the illustrated embodiment, the random access memroy 4 has a storage region of 64 bits by 20 bits as depicted in FIG. 3(1). The display panel 2 has the same bit number as the storage region as is seen from FIG. 3(2). Each of the bits of the random access memory 4 corresponds to each of the dots of the display panel 2.

In the following description, components and signals applied thereto may be denoted by the same reference number. In FIGS. 2, 13, 14, 15 and 120 indicate the numbers of bits of signal lines. The reference symbols AD-0–AD7 indicate signals specifying the addresses of the random access memory with the signals AD0–AD5 for row selection and the signals AD6 and AD7 for column selection. Out of backplate timing signals H0–H19 for the display panel 2, (a) the timing signals H0–H7 correspond to AD6=0, AD7=0 during column selection, (b) the timing signals H8–H15 correspond to address signals AD6=1, AD7=0 during column selection and (c) the timing signals H16–H19 correspond to address signals AD6=0, AD7=1 during column selection. It is further noted that the segment electrodes S0–S63 of the display panel 2 correspond to address signals AD-0–AD5 for row selection.

FIGS. 4 to 8 show details of the random access memory 4 and its related circuits. The respective cells of the random access memory 4 are separated every other address and grouped into an even group 4a and an odd group 4*b*. The address signal A0 is used for column selection. Signals from the cells in the even group 4*a* are derived from the output terminals S0, S2, S4 . . . S62 as described above, whereas signals from the cells in the odd group 4b are derived from the output terminals S1, S3, S5 . . . S63. The signals from the cells in the even group 4*a* are fed to the shift register 5A of FIG. 2 for data transfer, whereas those from the odd group 4*b* are fed to the shift register 5*b*.

The address signals to be fed to the random access memory 4 are made available as follows. An address control 11 is supplied with signals from cells A0–A7 of an 8-bit register A having cells A0–A7 together with signals from cells C0–C4 of the 5-bit counter c having cells C0–C4. A data selector 12 is supplied with signals from the respective cells A0, A6 and A7 of the register A and the 5-bit counter h consisting of cells h0–h4. The cells C0–C4 and the cells h0–h4 are used for setup of serial signals SR0, SR1 useful in sequentially fetching the contents of the random access memory 4 for displaying purposes. The cells A0–A7 are connected to the random access memory 4 only when data transmission is desired and generally set up by conventional flip flops or latches. Therefore, the cells C0–C4 and the cells h0–h4 are normally used for address and data selection and transmission of external data is carried out in an interrupted manner. When such interruption takes place, address signals different from the address signals developing true display signals are fed so that normal display may be blocked due to disturbance of the display signals. The present invention provides a solution to this problem by provision of latch type flip flops 13 and 14 (see FIGS. 5 and 6) which serves as output data buffers for the random access memory and assures normal or non-disturbed display on the display panel 2 whenever interrupted data transmission takes place.

Figure 7:
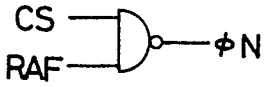
FIG. 7 is a diagram of the logic which develops the clock signal $\phi$N to be applied to flip flops 13 and 14.
Figure 8:
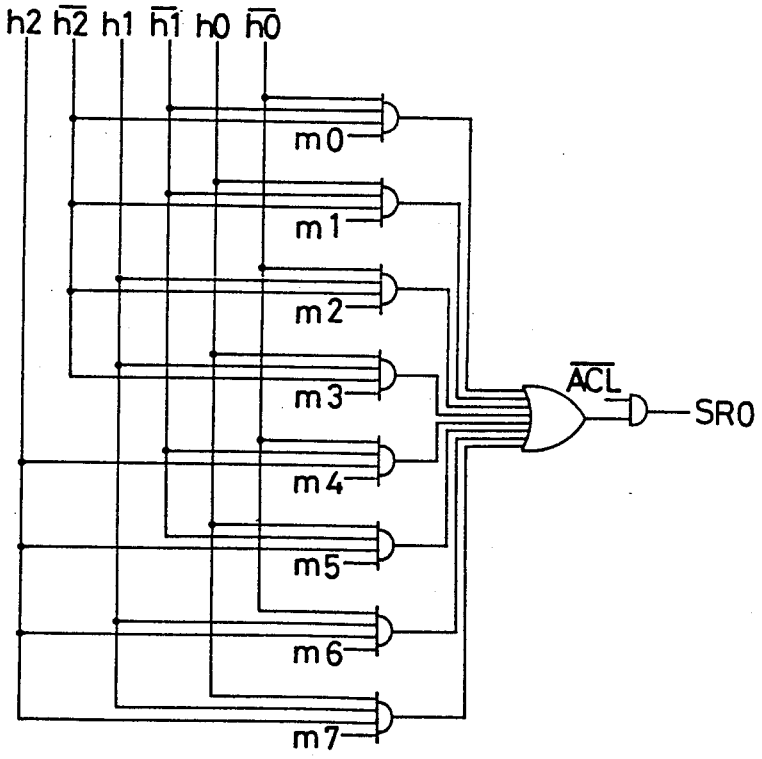
FIG. 8 is a diagram of the circuit arrangement for developing the signal SR0 (or SR1) to be applied to the shift register 5B (or 5A) of FIG. 2.

A signal CS in FIG. 7 is an output signal available from a flip flop CS of FIG. 2. The large scale integrated circuit CHIP 1 is selected and non-selected when CS=1 and CS=0, respectively. Signals RAS and RAF are ones that appear only when transmission of external data is necessary. When CS=1 and the signal RAS appears, address and data selection is achieved on the random access memory 4 with the help of the address signals A1 to A7. If CS=0 or the signal RAS is not developed, then an address decoder 15 which delivers signals for row selection of the random access memory 4 is supplied with signals from the cells C0–C4 of the counter c and a column selector 16 is supplied with signals from the cells h3 and h4 of the counter h. The counters c and h are used to generate the display signals as will be described below. The column selector 16 is connected to a group selector 17 for selection of either of the even group 4*a* and odd group 4*b* and a read/write control 18. A write clock WR is applied to the read/-write control 18. Signals Ni, Mi (i=0–7) from the group selector 17 are fed to the flip flops 13, 14 of FIGS. 5 and 6 whose outputs ni, mi are used in a circuit arrangement of FIG. 8. The signal SR0 is available in this manner from the circuit of FIG. 8 and the signal SR1 is available in a likewise manner.

Figure 9:
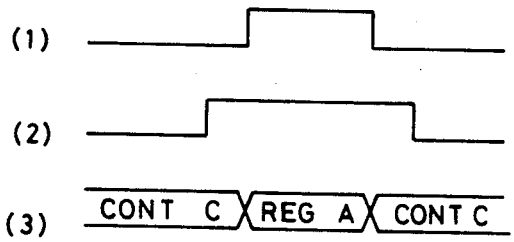
FIG. 9 is a waveform diagram for explaining operation of the display 2.

With reference to FIG. 9, the signal RAS is illustrated in FIG. 9(1), the signal RAF in FIG. 9(2) and the resultant signals used for addressing the random access memory 4 in FIG. 9(3).

Figure 10:
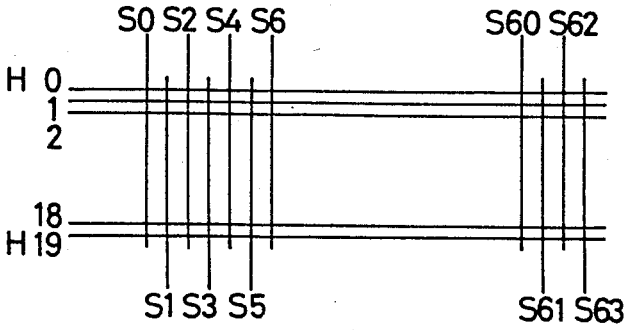
FIG. 10 is a diagram illustrating patterns of the display panel 2.

An electrode configuration of the display panel 2 is illustrated in FIG. 10 in which the segment electrodes are designated by the same reference numbers S0–S63 as its related signals and the backplates are also designated by the same reference numbers H0–H19 as its related signals.

Figure 11:
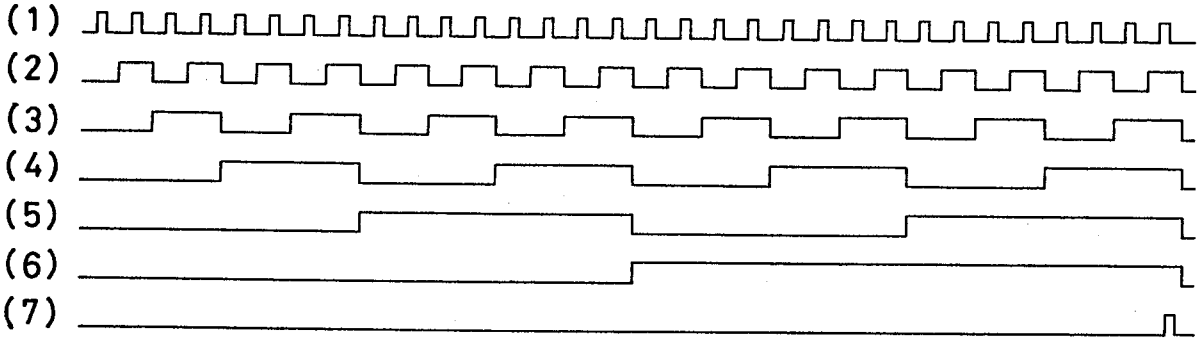
FIGS. 11 and 12 are waveform diagrams for explaining operations of counters c and h, respectively.
Figure 12:
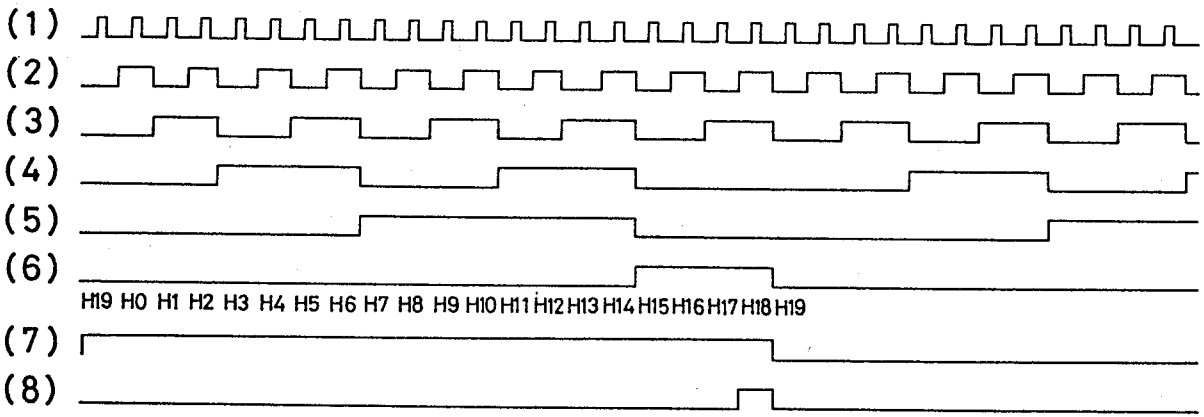
Figure 13:
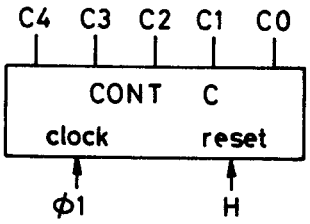
FIGS. 13 and 14 are block diagrams illustrating the counters c and h respectively.

FIG. 11 is a waveform diagram showing output states of the counter c and FIG. 12 is a waveform diagram of output states of the counter h. For example, while a signal is developed for driving the backplate H19, the cells h0−h4 are "0" and AD6=0, AD7=0 for column selection of the random access memory 4. Because of h0=h1=h2=0, in response to the signal SR0 (0)th bit line m0 of the even group 4*a* of the random access memory is scanned with the outputs from cells C0–C4 of the counter c with the results of development of series data. This is true with the signal SR1. While the backplate enabling signal H19 is developed, display data necessary for development of the next succeeding backplate signal H0 are shifted in the shift registers A, B and thereafter latched and delivered upon change from the signal H19 to H0. What follows is sequential incrementing of the counter h which enables the contents of the random access memory to be delivered in the form of the display signals.

Returning to FIG. 9, the signals RAS, RAF are developed when data are to be transferred from external to the random access memory 4. The flip flops 13, 14 (see FIGS. 5 and 6) become operable when clocked as follows:

$$\phi N=\overline{CS\cdot RAF}$$

When CS=0 or the signal RAF is not developed, that is, when $\phi$N=HIGH, the input signals Mi, Ni are outputted as they are. On the other hand, when CS=1 and the signal RAF is developed, that is, when $\phi$N=LOW, the data are held. During transmission of external data the signals RAS, RAF are developed so that the previous true display data may be held in the flip flops 13, 14 even if the output of the random access memory 4 is changed to other contents. This provides an effective measure by which to prevent disturbance of the display signals when interruption occurs. The reason why the signal RAF overlaps timewise with the signal RAS is that variations in the output signal when the address of the random access memory 4 is switched by the signal RAS should not be conveyed to the flip flops 13, 14. The signals RAS and RAF will be discussed below.

(2) Shift Registers 5A, 5B

As a means for fetching the contents of the random access memory 4 in the form of the display signals, the output of the random access memory 4 which is normally delivered every byte is converted into a serial signal, conveyed to the shift registers 5A, 5B and then retained in the latch circuits 19A, 19B in response to clocks $\phi$S synchronous with the display signals, for aquiring segment signals. As shown in FIG. 2, the shift register is divided into two blocks 5A, 5B, with one 5A assigned to the odd group of the segments and the other 5B assigned to the even group of the segments. The reason why the shift register is divided into the two groups 5A, 5B, the odd and even groups, is that the output terminals of the large scale integrated circuit CHIP 1 need be likewise divided into two groups, odd and even groups.

As described previously, FIG. 10 is an illustration showing an electrode pattern of the display panel according to the present invention. Pursuant to the concept of the present invention it is possible for the display panel to display "Kanji (Chinese characters)" and graphs. In this instance, with a large number of the segments, one approach to supply signals from input terminals S0*a*–S63*a* to the segment electrodes demands that the input terminals be divided alternatively into the upper and lower groups as viewed from FIG. 1 because of limits on terminal spacing. To avoid any crossing between lines communicating between the input terminals S0*a*–S63*a* and the output terminals S0–S63, the output terminals S0–S63 are also divided into two groups or odd and even groups. Another reason is that power dissipation in the large scale integrated circuits CHIP 1 to CHIP 16 should be reduced to a minimum. All that is necessary to transfer data from the random access memory 4 to the shift registers 5A, 5B is 32 clocks as long as the terminals are divided into the two groups. Otherwise, 64 clocks are necessary for data transmission. In order to generate 64 transfer clocks for a given period of time, it is necessary to make a standard oscillation frequency double, thus causing a doubled increase in power dissipation in the case of CMOS (complementary metal-oxide-semiconductor) implementations.

(3) Counters c, h

FIGS. 11 and 12 are time charts for the counters c, h. FIGS. 13 to 17 show details of the counters h, c and its related circuits. The counter c of FIG. 13 achieves counting performance in response to a standard clock $\phi$1 from the clock generator 10 as viewed from FIG. 11(1) and a clock $\phi$S as viewed from FIG. 11(7) is generated when C4·C3·C2·C1·C0=1. The counter c receives a signal H at its reset terminal for synchronous operation. The counter c is a×32 counter. FIGS. 11(2) to 11(6) depict the waveforms of the signals C0–C4, respectively. The clock $\phi$S is available from an AND gate of FIG. 15.

Figure 14:
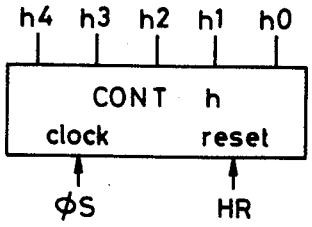
Figure 15:
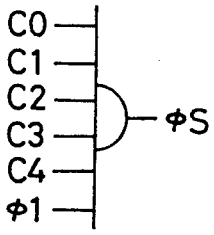
FIG. 15 is a diagram illustrating the logic for developing the clock $\phi$S.

The counter h of FIG. 14 is clocked with the clock $\phi$S produced by the gate of FIG. 15 as seen in FIG.

12(1) and reset with HR=H+HOR where H is a signal for synchronous operation and HOR in FIG. 12(8) is the signal as determined by outputs from a register N composed of cells N0–N3. FIGS. 12(2) to 12(6) show the waveforms of signals from the cells h0–h4, respectively, and FIG. 12(7) shows that of a signal HS.

Figure 16:
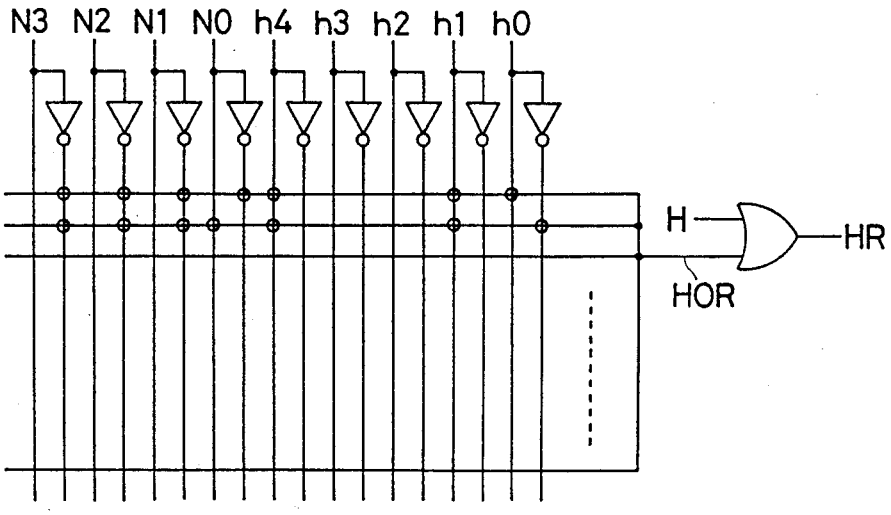
FIG. 16 is a diagram of a circuit for generating the rest signal HOR.
Figure 17:
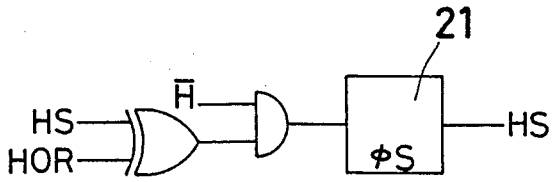
FIG. 17 is a diagram illustrating a flip flop 21 for generating the signal HS.

The register N is of the type wherein any number may be preset externally and a read only memory of a matrix configuration as shown in FIG. 16 is a circuit that generates the reset signal HOR for the counter h according to the count of the register N. It is clear from the waveform chart of FIG. 12 that the signal HOR is generated when $h4\cdot\overline{h3}\cdot\overline{h2}\cdot h1\cdot h0$ and the counter h serves as a×20 counter. The flip flop as shown in FIG. 17 for delivering the signal HS achieves synchronous operation with the signal H and inverts its state every signal HOR because it itself is kept in synchronism with the clock $\phi S$ and the input thereto is set up by $\overline{H}$ ($HS \oplus HOR$). It is therefore evident from the foregoing that the count of the counter h determines the duty cycle of the backplate (H0–H19) driving. The register N presets the duty cycle. The signal HS develops an alternating voltage.

(4) Serial-parallel Converter 6

Figure 38:
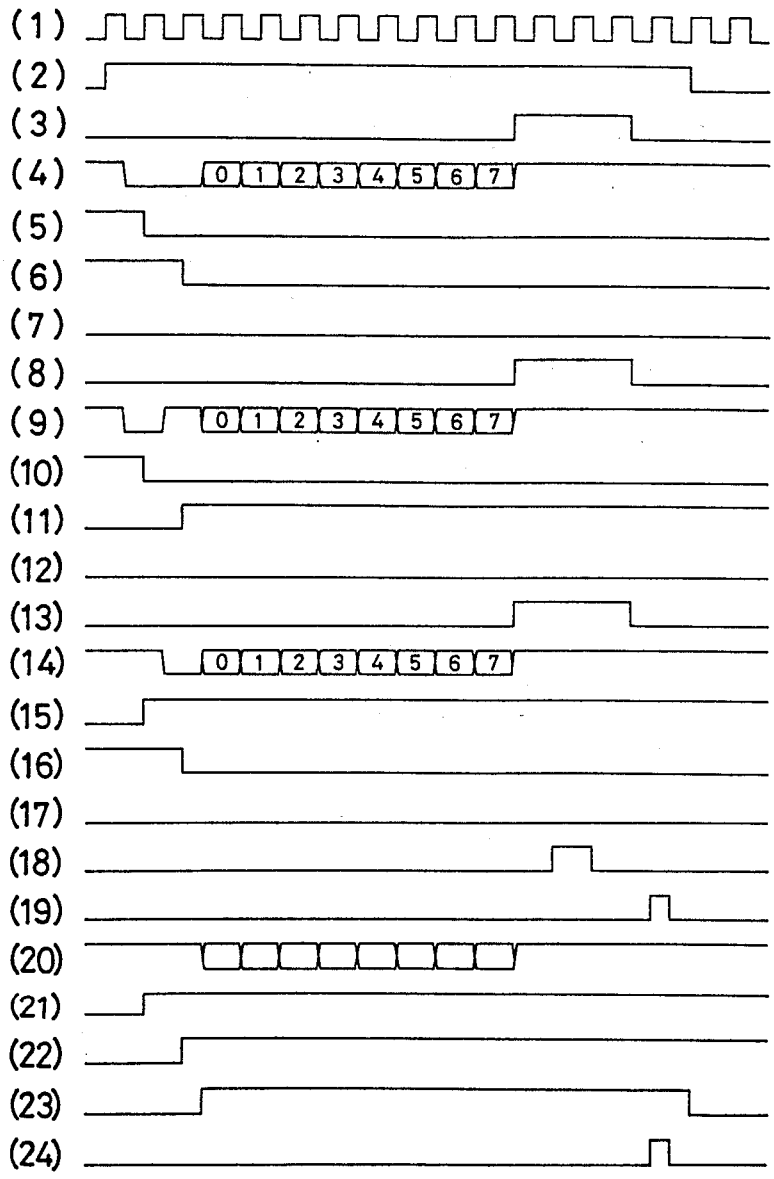

While data processing within the system takes place in a parallel fashion, data transmission to and from the exterior of the system should take place in a serial fashion and thus requires serial-parallel conversion. A register L is a shift register that has serial/parallel-out and parallel-in/serial out functions. FIG. 38(1) illustrates a signal CL0, FIG. 38(2) shows the waveform of a signal LC and FIG. 38(3) shows that of the signal RAS. The reference symbol SD0 denotes a serial data bus, CL0 denotes serial transfer clocks and LC denotes a sync signal.

Figure 18:
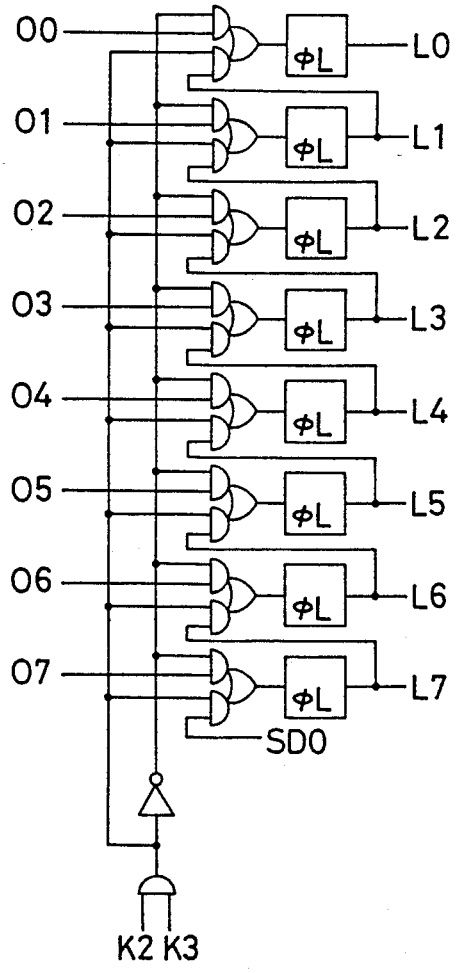
FIGS. 18 to 36 are block diagrams of circuitry of the register L used with the serial-parallel converter 6 of FIG. 2.

8-bit data transferred in a serial fashon via the terminal SD0 are retained in the register L of FIG. 18 temporarily and then used as data representative of the address of the random access memory 4, chip selection and the duty cycle and data sought to be loaded into the random access memory 4.

To fetch the contents of the random access memory 4 externally, the data in the random access memory 4 is first loaded in a parallel fashion into the register L and delivered to the exterior of the system through its shift operation. Additional 2 bits are provided before the 8-bit serial data, which bits are to identify the kind of data transmission. Different kinds of data transmission can be accomplished while sensing any one of four combinations "00", "01", "10" and "11," wherein "01" specifies writing of data representative of the duty cycle and chip selection, "01" specifies writing of data representative of the address of the random access memory 4, "10" specifies writing of data into the random access memory 4 and "11" specifies reading of data from the random access memory 4.

After writing or reading of data is executed on the random access memory 4, the register A is incremented automatically by one for addressing the random access memory 4. This eliminates the need for complicated operation necessary in addressing the random access memory 4 whenever data transmission is desired.

Figure 37:
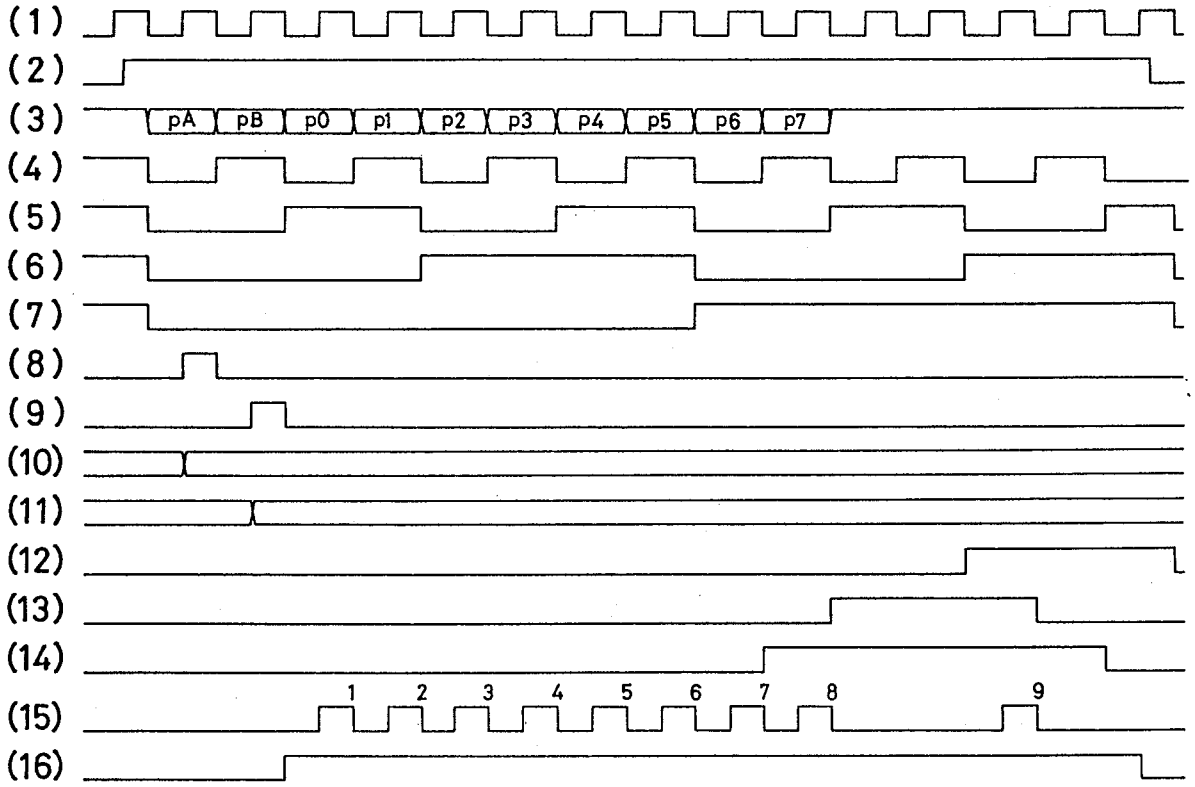
FIGS. 37 and 38 are waveform diagrams for explaining operation of the serial-parallel data transfer.

FIGS. 19 to 36 show details of the serial-parallel converter 6. FIGS. 37 and 38 are time charts during serial data transmission. Such serial data transmission starts with the leading edge of the signal LC as seen from FIGS. 37(2) and 38(2) essentially in response to the standard CL0 in FIGS. 37(1) and 38(1). More particularly, FIG. 37(1) depicts the waveform of the signal CL0, FIG. 37(2) that of the signal LC, FIG. 37(3) that of the signal SD0, FIGS. 37(4) to 37(7) those of outputs from the cells K0–K3, FIGS. 37(8) and 37(9) those of signals $\phi$LS0 and $\phi$LS1, FIGS. 37(10) and 37(11) those of the signals LS0 and LS1, FIG. 37(12) those of signals K3 and K2, FIG. 37(13) that of the signal RAS, FIG. 37(14) that of the signal RAF, FIG. 37(15) that of a signal FL, and FIG. 37(16) that of a signal SDD.

Figure 19:
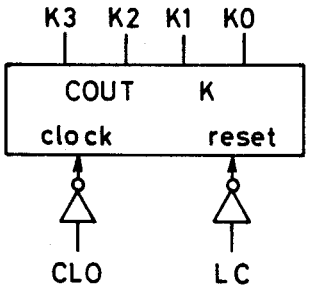
Figure 20:
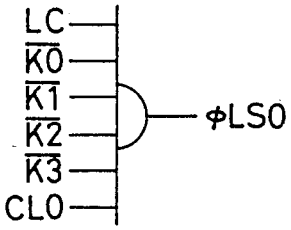
Figure 21:
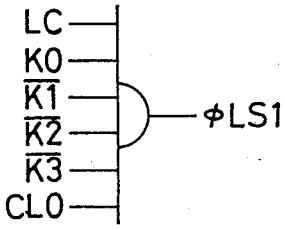
Figure 22:
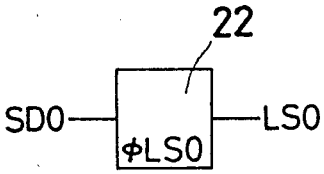
Figure 23:
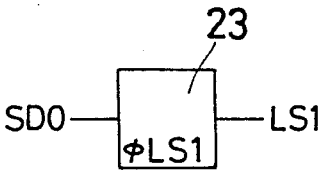
Figure 24:
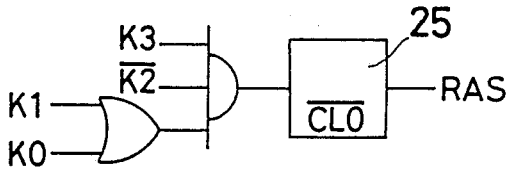
Figure 31:
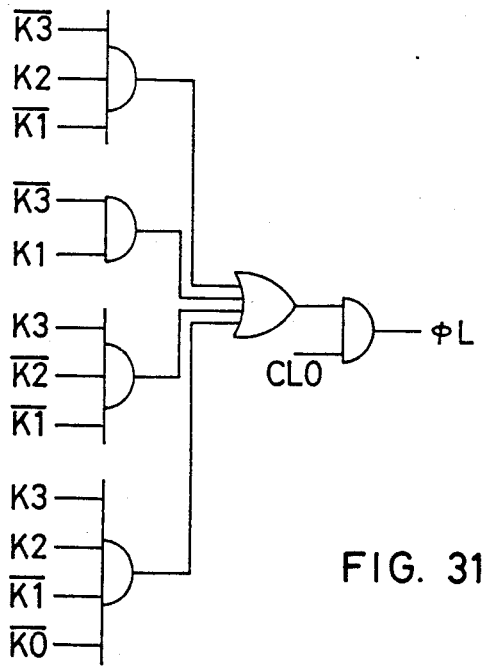
Figure 32:
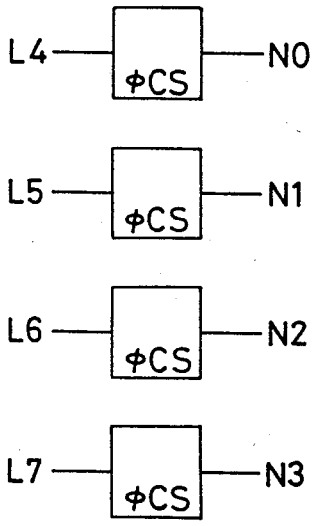
Figure 33:
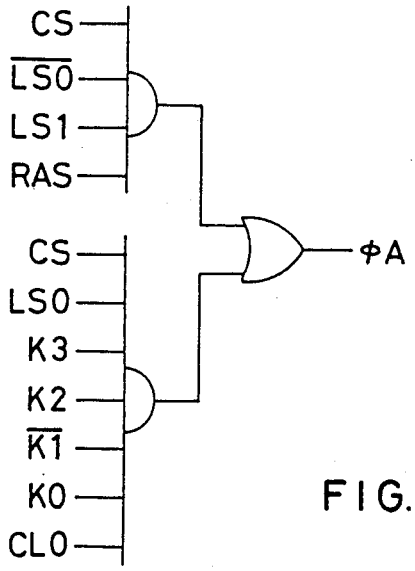
Figure 34:
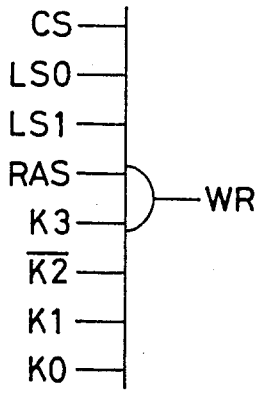

The counter K of FIG. 19 is a 4-bit binary counter that performs counting when the signal is "1" and reset when the same is "0", respectively. The counter K counts from "0" up to "14" to complete a sequence of serial data transfer. The data are 8 bits long with the additional 2 bits identifying the kind of data. The signal $\phi$LS0 in FIG. 20 and $\phi$LS1 in FIG. 21 are clocks for receiving the contents of the control 2 bits and flip flops 22, 23 of FIGS. 22 and 23 store the control 2 bits (the contents of bits PA and PB in FIG. 37(3)) in static mode during serial data transmission. $\phi$L originating from a circuit arrangement of FIG. 31 is to be fed to the register L and actually developed when the count K is either 2, 3, 4, 5, 6, 7, 8, 9 or 12. The first eight clocks enables the register L to perform shift operation and the last clock serves to take up the contents of the random access memory 4. This distinction is provided by signals K3–K2 which govern an input gate to the register L.

Figure 25:
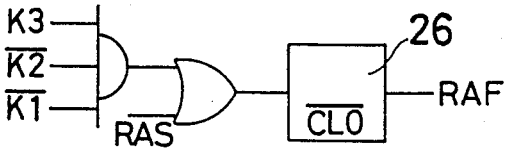
Figure 26:
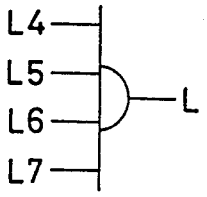
Figure 29:
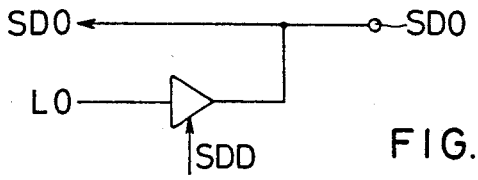
Figure 30:
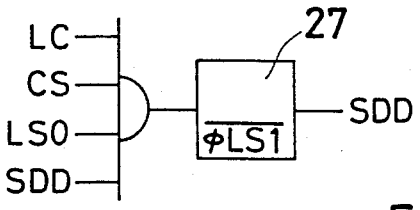

It is appreciated that the signal RAS is developed when the count K is either 10, 11 or 12 and the signal RAF of FIG. 25 is developed when the count K is 9, 10, 11, 12 or 13. The signal RAS is used as a clock for chip selection, writing of the duty cycle and writing of addresses as well as addressing of the random access memory during writing and reading of data. The signal RAF is discussed in paragraph (1). The signal SD0 in FIG. 29 is led from a bidirectional data line and is normally an input but is an output when the flip flop 27 of FIG. 30 is "1." As is obvious from a time chart of FIG. 38, the signal SDD is an output from the flip flop 27 which is placed into a set state when data are read out from the random access memory 4. This signal is set until transfer is completed for transmission of the serial data in the random access memory 4 to the exterior of the system after receipt of the control 2 bits.

Chip Select and Duty Cycle Writing

Figure 27:
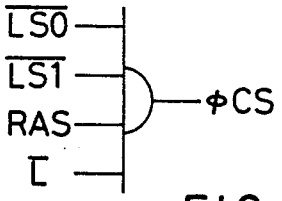

FIG. 38(4) shows the waveform of the signal SD0, FIG. 38(5) shows the waveform of the signal LS0, FIG. 38(7) shows the waveform of SDD and FIG. 38(8) shows the signal $\phi$CS. When the control 2 bits "00" are sent, LS0=0 and LS1=0, thus developing the clock $\phi$CS from the circuit configuration of FIG. 27. At the leading edge of the clock $\phi$CS the serial 8 bits following the control bits have been shifted, the upper 4 bits thereof being loaded into the register N details of which is typically illustrated in FIG. 32. As is clear from input conditions of the flip flop 28 for delivering the signal CS of FIG. 28, the flip flop 28 is in set state as long as there is agreement between codes fed to external chip select terminals CS0–CS3 and the contents of the lower 4 bits L0–L3. Otherwise, the flip flop 28 is reset. When chip select data are fed to the plurality of large scale integrated circuits CHIP, the flip flop CS leading to the large scale integrated circuit CHIP 1 selected by agreement with the codes and the flip flops 28 leading to the remaining chips CHIP 2–CHIP 16 are all reset. As shown in FIG. 27, the signal $\phi$CS is inhibited when L4=L5=L6=L7=1 as produced by the circuits of FIG. 26. This is due to the requirement that chip selection and duty cycle setting should be prohibited and auto clearing be released only when this code combination occurs. Address writing and data transfer to the random access memory 4 come into effect only when the flip flop 28 is in the set state.

Address Data Writing

Figure 35:
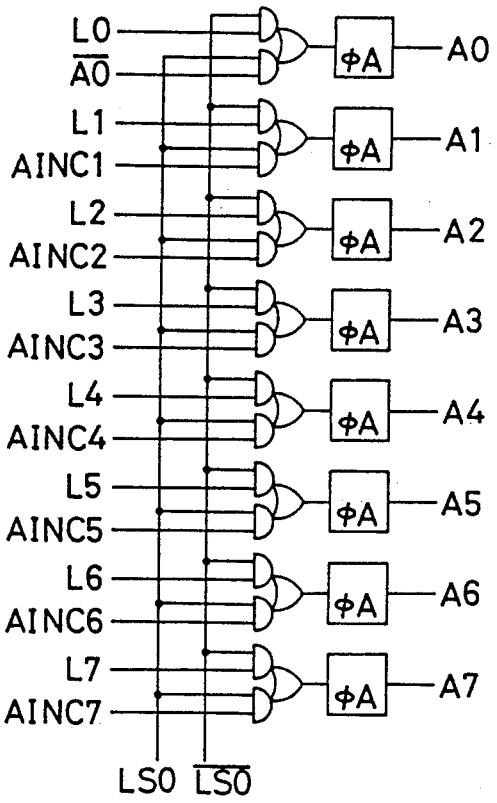
Figure 36:
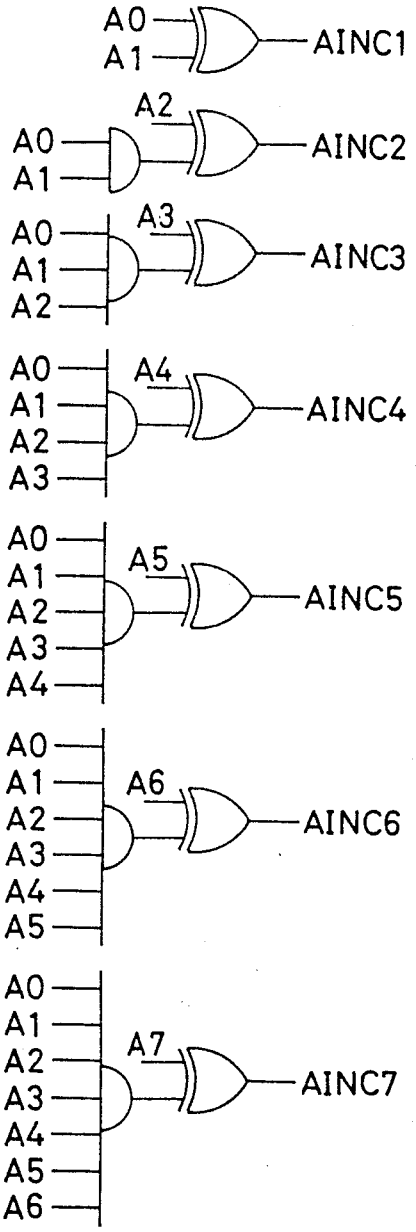

FIG. 38(9) shows the waveform of the signal SD0, FIG. 38(10) shows the waveform of the signal LS0, FIG. 38(11) shows the waveform of the signal LS1, FIG. 38(12) shows the waveform of the signal SDD and FIG. 38(13) shows the waveform of the signal $\phi$A. Upon supply of the control bits "01" LS0=0, LS1=1, enabling the clock $\phi$A from the circuit configuration of FIG. 33. When the signal $\phi$A rises, the following serial 8 bit data have been shifted in the register L. Because of LS0=0 as shown in FIG. 38(10), inputs to the address flip flops A0–A7 of FIG. 35 are from the cells L0–L7, so that writing of address data is achieved.

Data Writing to Random Access Memory 4

FIG. 38(14) shows the waveform of the signal SD0, FIG. 38(15) shows the waveform of the signal LS0, FIG. 38(16) shows the waveform of the signal LS1, FIG. 38(17) shows the waveform of the signal SDD and FIG. 38(18) shows the waveform of the signal $\phi$A. Upon supply of the control bits "10", LS0=1 and LS1=0, enabling the write clock WR to be developed for the random access memory 4 as viewed from FIG. 34. It should be appreciated that the signal WR is a clock present during the signal RAS. Shifting of the serial 8 bit data following the control bits has been completed over the register L while the signal RAS is present. As viewed from FIG. 2, the signals L0–L7 are applied as inputs to the random access memory 4 and loaded into the random access memory 4 upon the clock WR. When this occurs, the signal RAS enables the address decoder 15 and the column selector 16 to be fed with the signals A0–A7 from the circuit arrangement of FIG. 35. The result is that the data are written into the address as identified by the signals A0–A7. The clock $\phi$A is developed when the count K shows 13. Because of LS0=1, this signal $\phi$A increments the register A by one. This provides the ability to increment the address by one upon writing data and prompt data transfer without every identification of the address when data are to be written in a continuous fashion into the built-in random access memory 4.

Data Reading from Random Access Memory 4

FIG. 38(20) shows the waveform of the signal SD0, FIG. 38(21) shows the waveform of the signal LS0, FIG. 38(22) shows the waveform of the signal LS1, FIG. 38(23) shows the waveform of the signal SDD and FIG. 38(24) shows the waveform of the signal $\phi$A. Upon supply of the control bits "11", LS0=1 and LS1=0, placing the flip flop 27 into set state for delivering the signal SDD upon the succeeding bit of the serial data and enabling the terminal SD0 of FIG. 29 to receive the least significant bit L0 of the register L. Consequently, the contents of the shift register L are shifted upon the clock $\phi$L as developed by the circuit of FIG. 31 and led out as serial data from the terminal SD0. It is noted that the register L stores data in the random access memory 4 as addressed by the register A. The reason for this is that four operations as indicated in FIG. 38 are absolutely necessary before data are read out from the random access memory 4. It is common to the four operations that the clock $\phi$L and the signal RAS are always supplied.

Since the signal RAS is provided for the random access memory 4 at the leading edge of the last clock $\phi$L, the address signals A0–A7 supplied enables the contents of the random access memory 4 as addressed by A0–A7 in the form of its outputs O0–O7. These signals O0–O7 are fed to inputs to the register L as viewed from FIG. 18, so that the leading edge of the last clock $\phi$L permits fetching of the contents of the random access memory 4 as addressed by the signals A0–A7. The register L always stores the contents of the random access memory 4 when data reading from the random access memory 4 starts, so that it is possible to read the data in the random access memory 4 by shifting and leading out the contents of the shift register L. In this manner, the data can be read out from the random access memory 4.

The reason why the clock $\phi$A is developed at the end of the data reading from the random access memory 4 is identical with the data writing to the random access memory 4.

(5) Chip Select Control 7

The segment signals for the large scale integrated circuits CHIP 1 are 64 signals S0–S64. A larger number of the large scale integrated circuits CHIP 1 to CHIP 16 are very often used. In such case, to select a desired one of the plurality of the large scale integrated circuits, the chip select terminals CS0–CS3 are provided. The use of the four chip select terminals CS0–CS3 allows connection of up to 16 large scale integrated circuits CHIP 1 to CHIP 16. One of significant advantages of the present invention is that there is no need for particular signal lines leading from the exterior of the system for guiding the chip select signals and all that is necessary is to connect them to the ground GND or a power level VCC.

Figure 39:
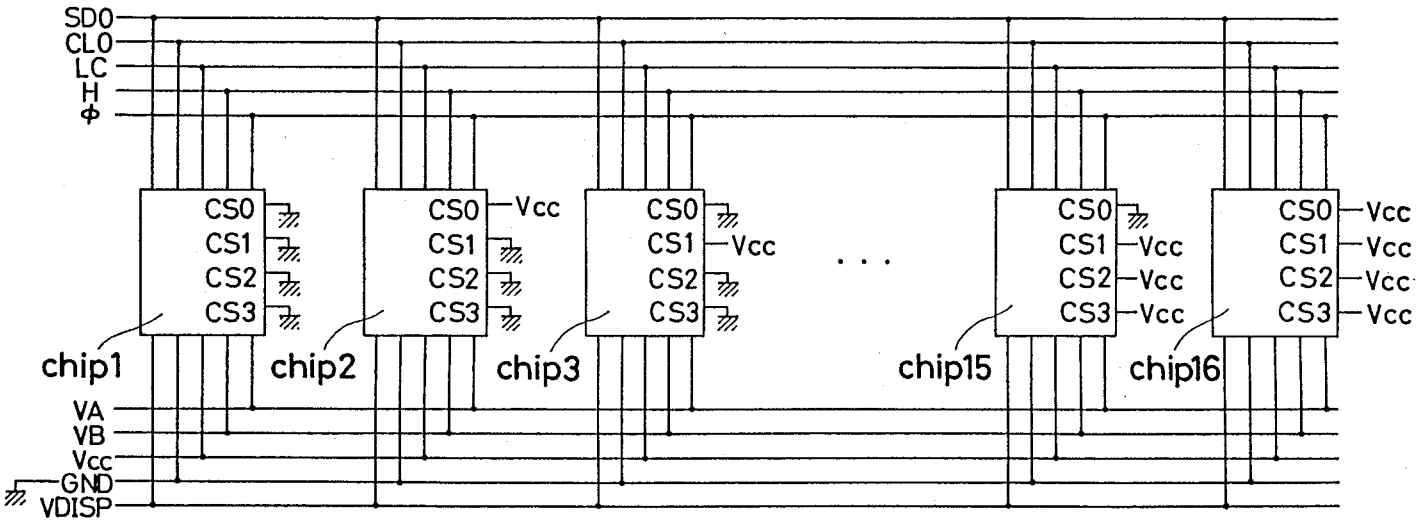
FIG. 39 is a block diagram illustrating interconnections among large scale integrated circuits CHIP 1 to CHIP 16.

FIG. 39 is drawn when the 16 large scale integrated circuits CHIP 1 to CHIP 16 are in use. In this instance only SD0, CL0 and $\phi$H are signals lines necessary to deal with the chip select signals. Power lines VA, VB, VCC, GND and VDISP are all that is necessary. With a total of 10 lines, up to 16 large scale integrated circuits CHIP 1 to CHIP 16 are connectable and this feature is very effective for enrichment of packing density.

Figure 28:
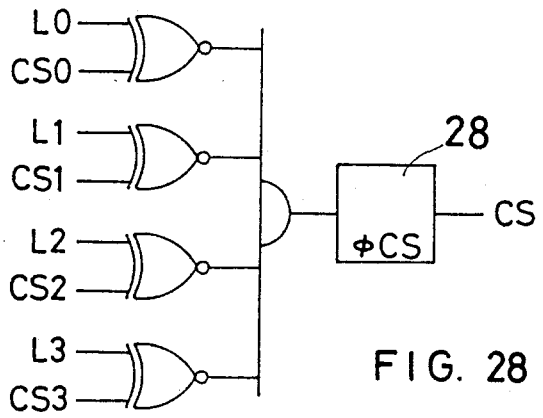

In FIG. 28, there is illustrated the flip flop CS which, when in the set state selects the large scale integrated circuit CHIP 1 and in reset state does not select the same. The chip select data are fed as serial signals from outside to the cells L0–L3 of the register L. If the contents of the cells L0–L3 agree with those at the chip select terminals CS0–CS3. then the flip flop CS is placed into the set state. If both disagree, then the flip flop CS remains in the reset state. Provided that a writing or reading instruction is fed as for the address data and intelligent data for the random access memory 4, the large scale integrated circuits that accept this instructiuon are only the large scale integrated circuit CHIP 1 whose associated flip flop CS is in set state. The remaining large scale integrated circuits CHIP 2 to CHIP 16 whose associated flip flops CS remain in the reset state do not accept such an instruction. The flip flops CS are supplied with the clock CS available from the circuit configuration of FIG. 27. The setting and resetting conditions of the flip flops CS are fully discussed in the foregoing description.

It is to be understood that the respective flip flops and the signals leading from those flip flops are designated by the same reference symbols throughout the specification for the convenience of explanation only.

(6) Auto Clear

Figure 40:
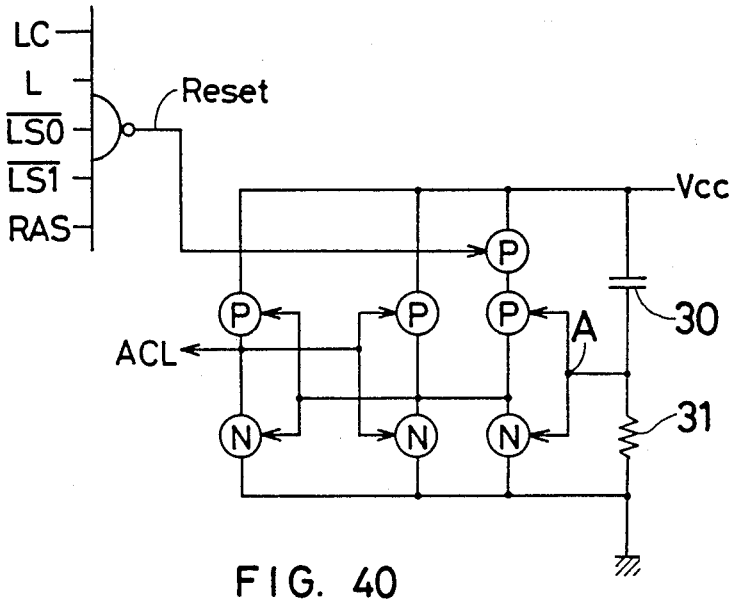
FIG. 40 is a block diagram illustrating a latch (or flip flop) ACL.

Another significant feature of the present invention of the system embodying the present invention is that the backplate and segment signals and the duty cycle are governed by a software outside the system. In the case of software processing, it takes some time to generate normal signals after power is turned on and thus, a normal display is not expected on the display panel 2, greatly deteriorating the commercial value of products. According to the present invention, a built-in flip flop ACL of FIG. 40 is set immediately after initial power application. While the flip flop ACL is in the set state, data to the shift registers 5A, 5B are always zeros to keep the display panel 2 in its disabled state.

It is noted that the reference symbols P, N in FIG. 40 represent P channels and N channel transistors.

To place the flip flop ACL into reset state, an external signal is used. In the illustrated embodiment, when codes "1111" are fed, no duty cycle is set and the flip flop ACL is reset.

Software determines, after initial power application, initial values of backplate and segment signals as well as the proper duty cycle. Should the flip flop ACL be then brought into the reset state, it is possible to move the display panel 2 from its disabled state to normal enabled state.

Figure 41:
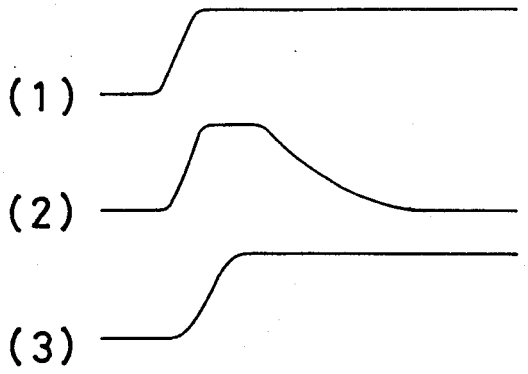
FIG. 41 is a waveform diagram for explaining operation of the latch ACL as shown in FIG. 40.

When the flip flop ACL is supplied with VCC as indicated in FIG. 41(1), the potential at node A traces a waveform as shown in FIG. 41(2) through operation of a capacitor 30 and a resistor 31. This situation is envisaged until a reset input is applied. As previously discussed with respect to FIG. 9, the flip flop ACL is to shut off the inputs SR$\phi$, SR1 to the shift registers 5A, 5B. The display remains in the disabled state since the shift registers 5A, 5B are fed with data "0" while the flip flop ACL is maintained at "1." To release the flip flop ACL, codes corresponding to a desired duty cycle, i.e., "1111" are selected during chip selection and duty cycle writing to create a reset signal RESET as indicated in FIG. 40. The flip flop ACL is released consequently.

(7) Drivers 9A, 9B

Figure 42:
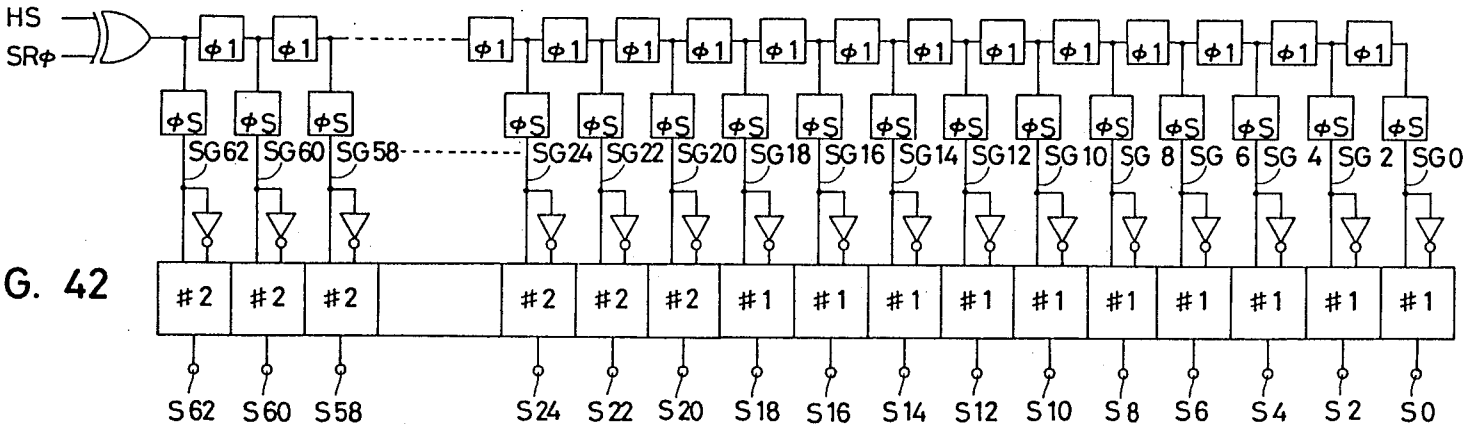
FIGS. 42 and 43 are diagrams of the circuitry of Shift Register 5B and LATCH 19B and the circuitry of Shift Register 5A and LATCH 19A, respectively.
Figure 43:
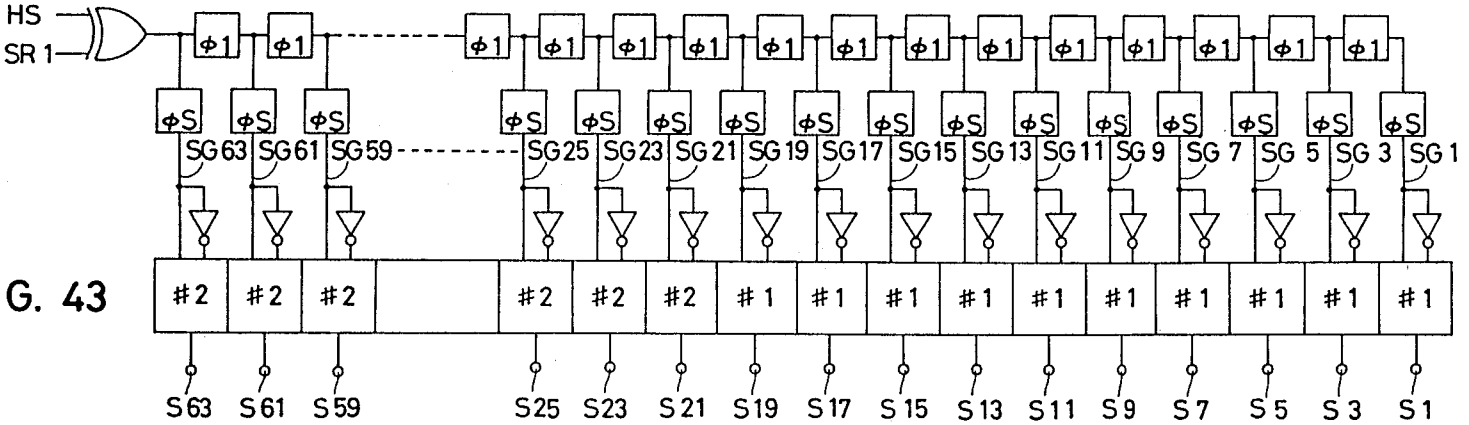

Details of the drivers 9A, 9B are illustrated in FIGS. 42 and 43. Inputs to the shift registers 5A, 5B comprise the exclusive OR'ed sum of the signals HS and SR$\phi$and the counterpart of the signals HS and SR1. The purpose of this is to create inverted signals in timed relation with the signal HS. The clocks $\phi$1, $\phi$S are identical with the clocks $\phi$1, $\phi$S shown in the time charts of FIGS. 11 and 12. The signals SR0, SR1 after conversion to serial signals are shifted through the shift registers 5A, 5B upon the clock $\phi$1 and latched in the succeeding flip flop upon the clock $\phi$S.

Figure 45:
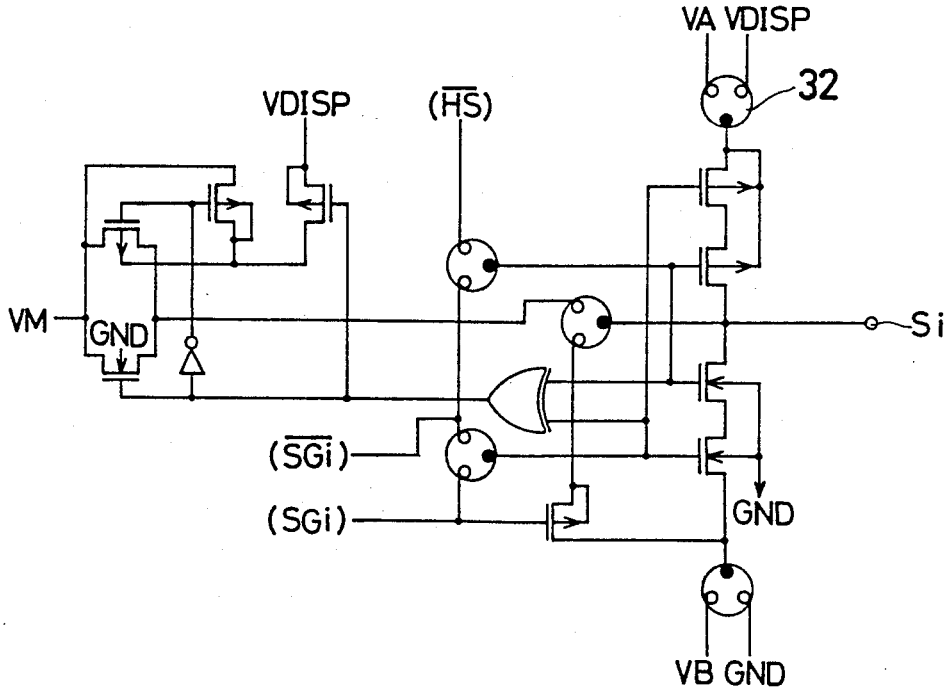
FIGS. 45 and 46 are examples of the circuitry of the liquid crystal driver cells #1, #2 of FIGS. 42,43.
Figure 46:
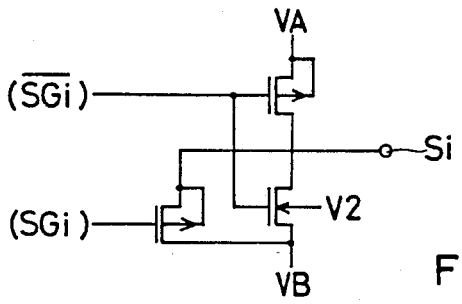

The signals SG0–SG63 in FIGS. 42 and 43 are the segment signals latched in synchronism with the clock $\phi$S. There are provided liquid crystal driver cells #1, #2 of which designs are illustrated in FIGS. 45 and 46. It is noted that FIG. 46 shows the segment driver for the display panel 2, while FIG. 45 shows the segment-/backplate driver selectable by using different masks for the large scale integrated circuit CHIP 1. Cells denoted by 32 and equivalents serve as a changeover switch.

Figure 44:
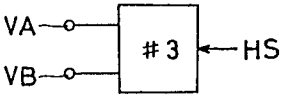
FIG. 44 is a diagram of the circuitry of a driver associated with the circuitry of FIGS. 45–50.
Figure 47:
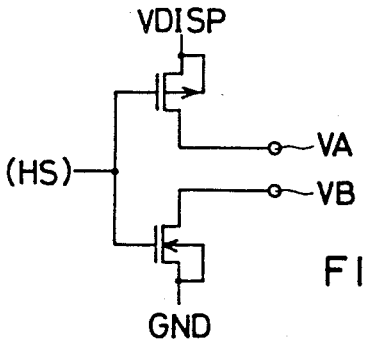
FIG. 47 is the power supply for supplying power to driver #3 of FIG. 44.
Figure 48:
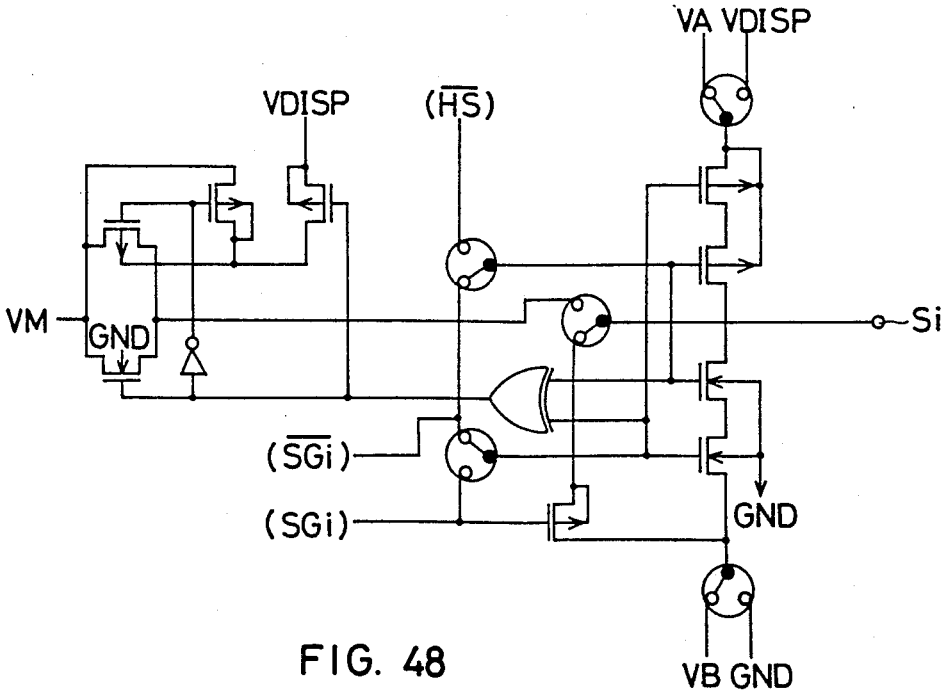
FIGS. 48 and 49 illustrate possible connections of the driver cell #1 with segment and backplate electrodes, respectively.
Figure 49:
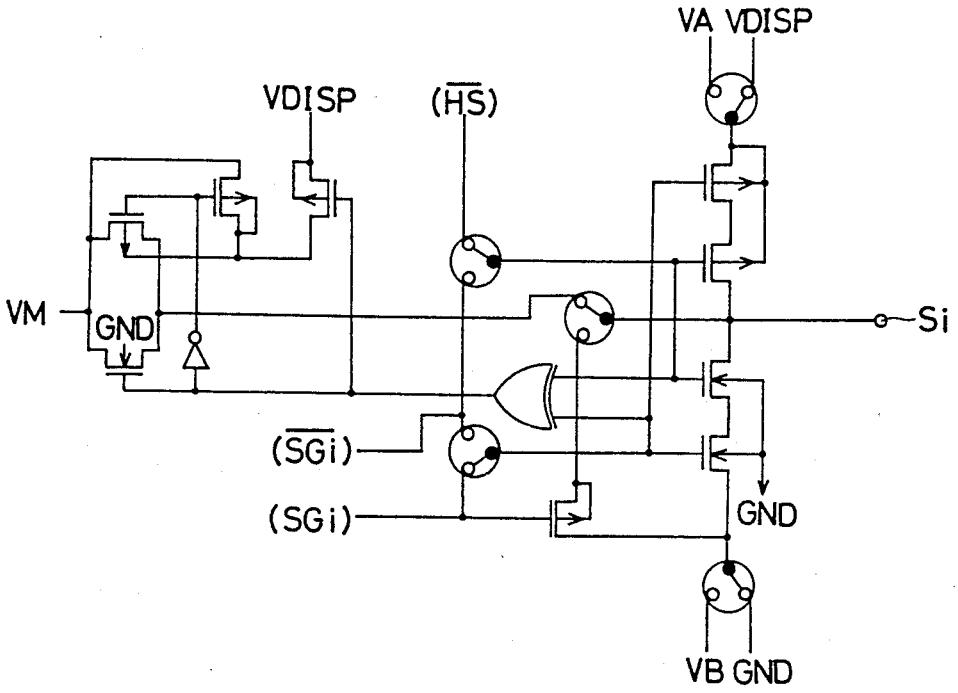
Figure 50:
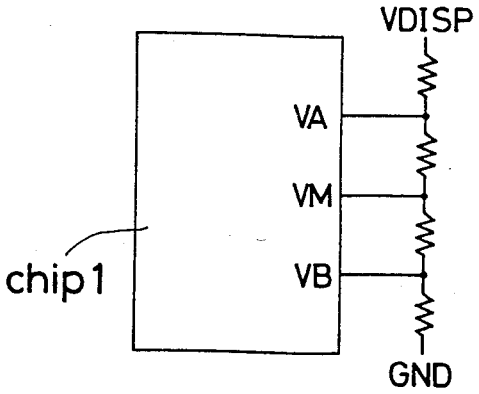
FIG. 50 is a block diagram of connections between the large scale integrated circuit CHIP 1 and a power supply.
Figure 51:
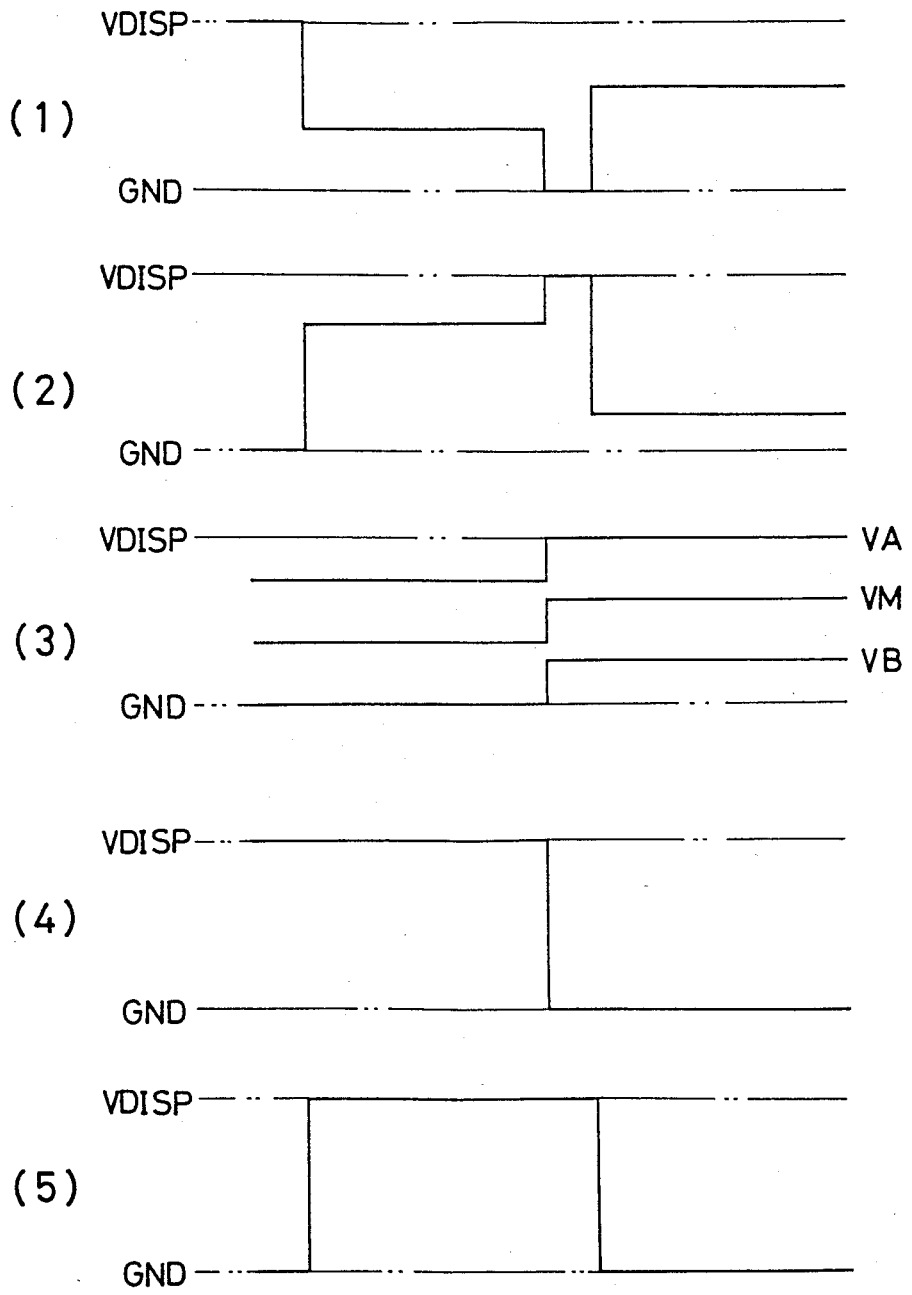
FIG. 51 is a waveform diagram illustrating signals for display on the display panel 2.

In the illustrated embodiment, the output terminals S0–S19 are connected to the driver cell #1 to output either the backplate signals or the segment signals. FIG. 47 shows a setup of a power supply to a driver #3 in FIG. 44. FIG. 50 shows connections with VA, VB and VM and FIG. 51 shows a time chart of display operation. Furthermore, FIGS. 48 and 49 illustrate connections of the driver cell #1 when selecting the segments and backplates. In those drawings, (SGi), Gi)/ , S)/ are the signals SGi, $\overline{SGi}$, $\overline{HS}$ with level conversion. The backplate signals are illustrated in FIG. 51(1), the segment signals are illustrated in FIG. 51(2), the levels VA, VB, VM are illustrated in FIG. 51(3), the signal (HS) is illustrated in FIG. 51(4), and the signal (SG0) is illustrated in FIG. 51(5), respectively.

As another significant feature of the present invention, whether the signals fed are the backplate signals or the segment signals is determined by only selecting the output of the last driver as the backplate signals or the segment signals and the data in the random access memory 4 can be dealt with in the same manner regardless of the backplate signals or the segment signals.

Figure 52:
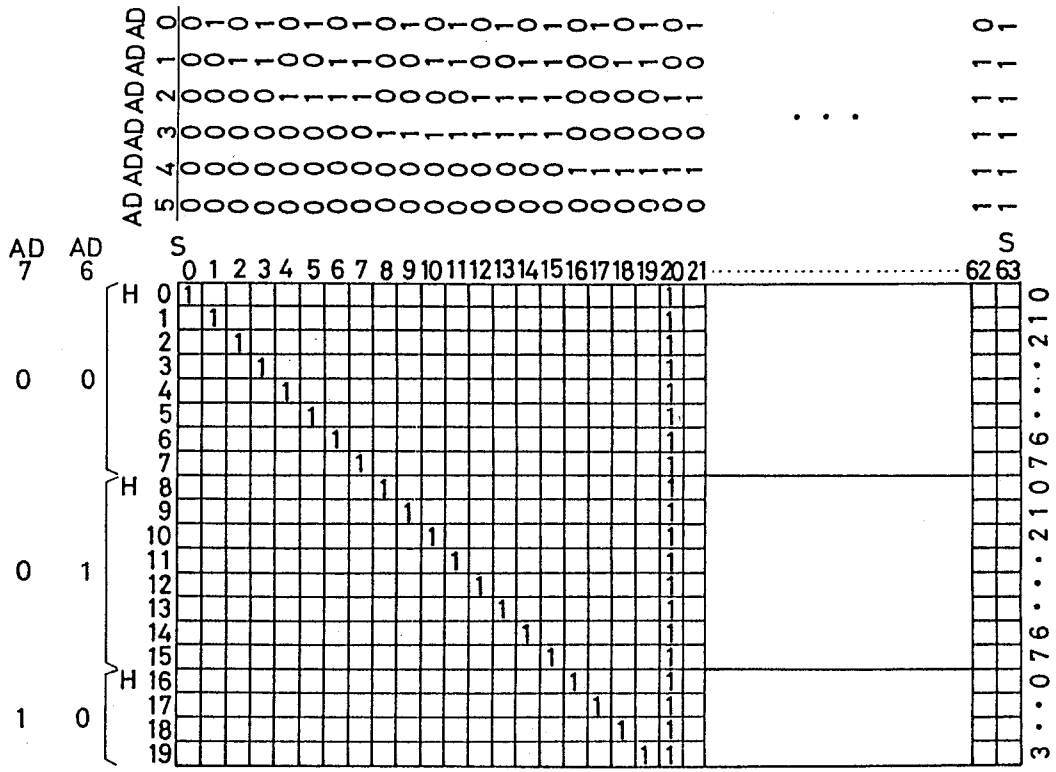
FIG. 52 is a view illustrating store regions of the random access memory 4 when backplates S0 to S19 are employed.

FIG. 52 shows a data array in the random access memory 4 when the signals S0–S19 are to be fed to the backplate electrodes. In this case, data are select so as to establish a duty cycle of 1/20 and the counter h performs counting as seen from FIGS. 11 and 12. At the backplate timing H19 data on (0)th line of the random access memory 4 as specified by A7A6=00 are shifted to the shift registers 5A, 5B. The latch clock $\phi$S enables the flip flops to output the signals SG0–SG63 at the next succeeding backplate timing H0. The driver responsive to the signal SG0 is shown in FIG. 49. In addition, since inputs to the shift registers 5A, 5B comprise SR$\phi\oplus$HS and SR1$\oplus$HS, the output signal SG0 bears the waveform of FIG. 51(5) and the backplate signal bears the waveform of FIG. 51(1).

The signals SG20–SG63 are fed to the segment driver as shown in FIG. 46 and takes the waveform as shown in FIG. 51(5). By modifying the setting in the register N, it is possible to vary optionally the duty cycle of the display panel 2. The order of the backplate signals developed can also be altered optionally by changing the data in the random access memory 4.

(8) Clock Generator 10

It is noted that the large scale integrated circuits CHIP 1 to CHIP 16 each have its own unique clock generator 10 for individual display performance. When the plurality of the large scale integrated circuits CHIP 1–CHIP 16 are to be connected, the clock generator 10 of only one of the large scale integrated circutis is allowed to oscillate and the remaining large scale integrated circuits CHIP 2 to CHIP 16 receive the standard clock and sync signals to assure synchronized operation of the overall system. The standard clock is $\phi$ and the sync signal is H in FIG. 2. Whether to generate or receive the standard clock $\phi$ and the sync signal H is determined by masks for the large scale integrated circuits CHIP 1 to CHIP 16.

The counters h, c, HS are asynchronous after initial power application, but become synchronous upon recept of the first sync signal H. The sync signal H is developed every frame of the display panel 2 to assure synchronous operation every frame. It is earlier noted that the sync signals H place the conters h, c and H into reset state or synchronized state as discussed with reference to FIGS. 13 to 17. The signals H are available from the circuit arrangement of FIG. 53 and have the longest period out of the repetitive signals, with the pulse width equal to the period of the clock $\phi$1.

Figure 53:
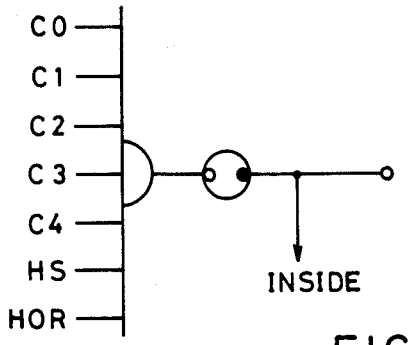
FIG. 53 is a block diagram of a circuit arrangement for generation of sync signals H.

As is clear from FIG. 53, the sync signals H are supplied either to or from the exterior of the system, and this mode is selectable depending upon the mask.

The clock $\phi$1 in FIG. 11 is used internally of the CHIP and two-phase clocks $\phi$1, $\phi$2 are developed in the illustrated embodiment though not shown in FIG. 53. $\phi$ as shown in FIG. 2 is the standard clock for setup of the two-phase clocks $\phi$1, $\phi$2. It is understood that the clocks $\phi$1 $\phi$2 are asynchronous among the large scale integrated circuits CHIP 1 to CHIP 16 but the sync signals H serve to maintain the two-phase clocks $\phi$1, $\phi$2 in synchronous relation.

Figure 54:
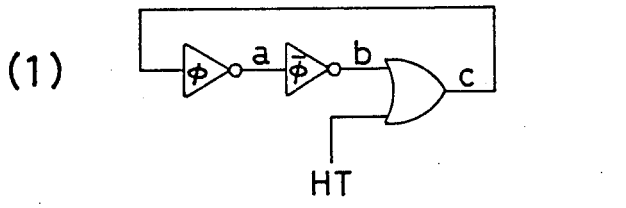
FIG. 54 illustrates, by block diagrams, a circuit arrangement for generating clocks $\phi 1$ and $\phi 2$.
Figure 55:
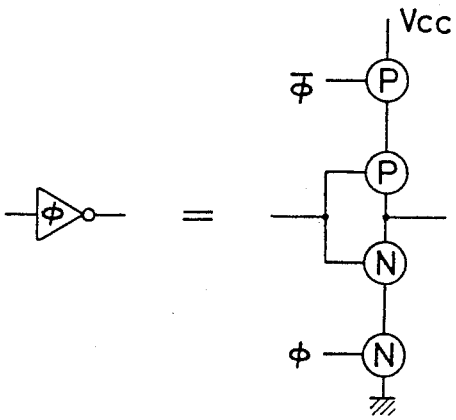
FIG. 55 is a diagram illustrating the details of the clocked inverter used in FIG. 54.
Figure 56:
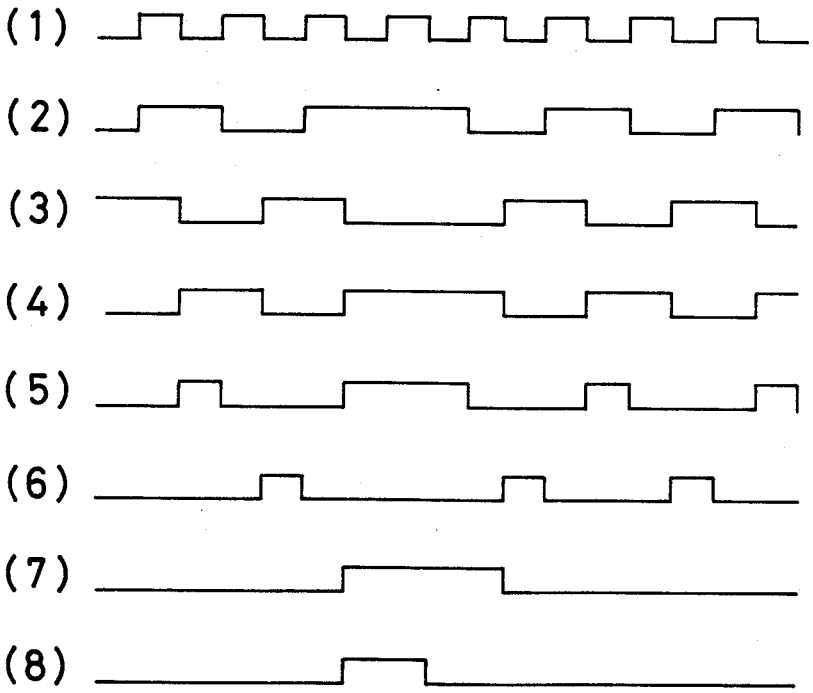
FIG. 56 is a waveform diagram illustrating the sync operation of the large scale integrated circuit CHIP 1.

FIG. 54 shows a generator for generating the two-phase clocks used in the illustrated embodiment. A signal HT, as shown in FIG. 54(4), is developed based upon the signal H and serves to synchronize the two-phase clocks $\phi$1, $\phi$2. A time chart of FIG. 56 indicates that the phases of $\phi$1, $\phi$2 are modified with regard to the signals H with the action of the signal H. FIG. 56(1) shows the waveform of the clock $\phi$, FIGS. 56(2) to 56(4) show those of signals a, b, c for use in the circuits of FIGS. 54(1) to 54(3), FIG. 56(5) shows the clock $\phi$1, FIG. 56(6) shows the clock $\phi$2, FIG. 56(7) shows the sync signals H and FIG. 56(8) shows the signal HT. Details of the circuit arrangement of FIG. 53(1), 53(4) are illustrated in FIG. 56(2).

Whereas the present invention has been described with respect to specific embodiments thereof, it will be understood that various changes and modifications will be suggested to one skilled in the art, and it is intended to encompass such changes and modifications as fall within the scope of the appended claims.

What is claimed is:

1. A display drive system for driving a flat panel display for displaying desired data, said drive system being responsive to external data provided from an external device, said system comprising:

random access memory means for storing said data to be displayed on said display;

control means for controlling the application of said data to said display from said random access memory means, said control means including a latch means for inhibiting the application of said data to said display when in a first state and for passing said data to said display when in a second state;

disturbed state prevention means for controlling said latch means to selectively inhibit the application of said data to said display, said disturbed state prevention means placing said latch means in the first state to inhibit the application of data to said display upon the initial application of power to said system; and means for monitoring the processing of data by said control means and for developing a reset signal responsive thereto;

said disturbed state prevention means being responsive to said reset signal developed by said means for monitoring for placing said latch means in said second state to pass data to said display, said latch means including timing means for inhibiting the placing of said latch means in said second state for a predetermined minimum time period.

2. A display drive system as defined in claim 1 wherein said display comprises a liquid crystal display panel.

3. A display drive system as defined in claim 1 wherein said latch means comprises a latch type flip flop serving as an output data buffer for said random access memory.

4. The display drive system of claim 1 wherein said disturbed state prevention means further controls said latch means to inhibit the application of said data to said display when data transfer into said random access memory is occurring simultaneous to the application of data from said random access memory means to said display.

5. A display drive system as defined in claim 4 wherein said disturbed state prevention means clocks said latch type flip flop with a signal $\phi N = \overline{CS \cdot RAF}$ where CS is a chip select signal and RAF is a signal when data transfer is to take place into said random access memory.

* * * * *